US005370071A

United States Patent [19]

Ackermann

[11] Patent Number: 5,370,071

[45] **Date of Patent: * Dec. 6, 1994**

[54] LAP SEAMER DEVICE FOR SEWING MACHINE

[75] Inventor: Manfred Ackermann, Elmhurst, Ill.

[73] Assignee: Union Special Corporation, Huntley, Ill.

[ * ] Notice: The portion of the term of this patent subsequent to Jun. 29, 2010 has been disclaimed.

[21] Appl. No.: 75,816

[22] Filed: Jun. 11, 1993

Related U.S. Application Data

[63] Continuation-in-part of Ser. No. 757,558, Sep. 11, 1991, Pat. No. 5,222,450.

[51] Int. Cl.[5] ..... D05B 35/02

[52] U.S. Cl. ..... 112/142; 112/235; 112/151; 112/122

[58] Field of Search ..... 112/142, 235, 151, 122

[56] References Cited

U.S. PATENT DOCUMENTS 2,915,996 12/1959 Charest .
3,096,735 7/1963 Wise .
3,257,979 6/1966 Michaud .
3,370,559 2/1968 Longcore .
4,321,880 3/1982 Boser .
4,526,113 7/1985 Angele .
5,222,450 6/1993 Ackerman ..... 112/142

FOREIGN PATENT DOCUMENTS

3618462A1 3/1987 Germany .
1586901 3/1981 United Kingdom .

OTHER PUBLICATIONS

Union Special, Catalog No. 118L Third Edition, Class 36200 High Speed Cylinder Flatseamer Machines.
Union Special, Catalog No. T118 H, 36200 High Speed Sylinder Flatseamer Machines.

*Primary Examiner*—Clifford D. Crowder
*Assistant Examiner*—Paul C. Lewis
*Attorney, Agent, or Firm*—Willian Brinks Hofer Gilson & Lione

[57] ABSTRACT

A device for sewing together two plies of cloth with a lap seam. The device comprises a cloth guide that is disposed between a plurality of reciprocating needles and the front of a cutting knife. The guiding portion of the cloth guide extends substantially between the needles and the front edge of the cutting knife. A cloth guide for assuring a full lap of material when sewing a lap seam where the left ply is to be laid on top of the right ply is also provided.

10 Claims, 4 Drawing Sheets

LAP SEAMER DEVICE FOR SEWING MACHINE

This application is a continuation in part of my application Ser. No. 07/757,558 filed Sept. 11, 1991, entitled "Seamer Device For Lap Sewing Machine," now U.S. Pat. No. 5,222,450.

BACKGROUND OF THE INVENTION

The invention relates to sewing machines, and specifically to sewing machines that perform a lap seam stitch.

A lap seam is generally sewn on a feed-off-the-arm sewing machine, and is used to join two plies of material that are positioned on top of one another. In one method, the plies are presented to the machine with the ends turned up. The machine trims the ends, folds the trimmed ends down on top of one another and sews the lap seam stitch. The terms "sewing on" and "sewing off" refers to the practice of starting the stitch forming process before feeding the material to be stitched to the needle area and then continuing the stitch forming process after the material being stitched has exited the needle area. When "sewing on" and "sewing off" with a standard 607 stitch a ribbon is formed prior to where sewing began and again where sewing ceased. These ribbons of stitching are trimmed off the finished product.

The lap seam stitch is used on many knitted garments, such as men's briefs, sweatshirt and sweatpants. These garments have a thick binding at each end that generally runs perpendicular to the direction of the lap seam and frequently contains an elastic material.

When sewing on or off the machine with these types of garments a peak in the binding may develop. When peaking occurs, the binding of the left ply does not align, along a straight line, with -the binding of the right ply. Instead, either a gap or an angle in the binding is observed. Peaking causes the material to be susceptible to tearing, is unsightly, and is uncomfortable to the wearer. Accordingly, peaking in the lap seaming stitch is not acceptable.

One attempt at solving the peaking problem has been to lay the left ply down flat and trim the right ply only. But this procedure reveals the raw edge of the untrimmed left ply because it is not sewn inside the width of the stitch.

This invention solves the peaking problem and provides for trimming of both the left and the right ply. Thus, when sewing a lap seam stitch on two plies with bindings, the binding is align with one another when sewing on and off the garment. In addition, because both the left and the right ply are trimmed, a clean seam showing no raw edge is produced.

SUMMARY OF THE INVENTION

The invention provides a device for sewing together two plies of cloth with a lap seam comprising a cloth guide that is disposed between a plurality of reciprocating needles and the front of a cutting knife. The guiding portion of the cloth guide extends substantially between the needles and the front edge of the cutting knife to control the plies of cloth.

For a lap seaming operation where the right ply is on the top, the cloth guide is located to the left of the area where the plies are laid down and sewn. For a lap seaming operation where the left ply is on the top, the cloth guide is located to the right of the area where the plies are laid down and sewn.

In another embodiment, the present invention provides a second cloth guide located to the left of the area where the plies are laid down and sewn. The second cloth guide provides a full lap of material when sewing a lap seam where the left ply is to be laid on top of the right ply.

DETAILED DESCRIPTION OF THE DRAWINGS AND PREFERRED EMBODIMENTS

Figure 1:
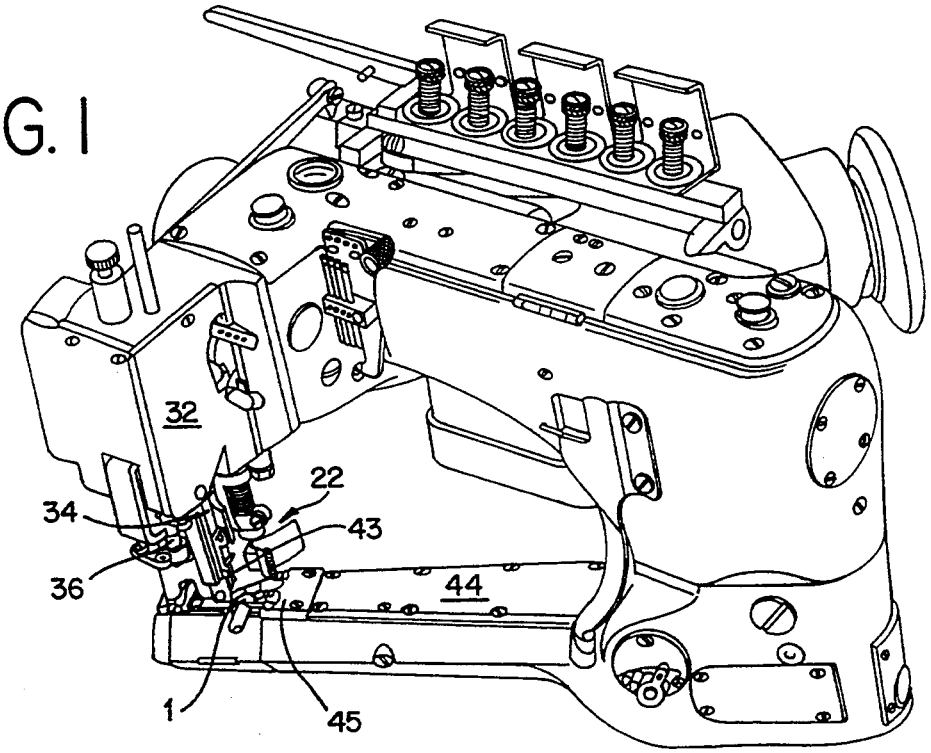
FIG. 1 is a perspective view of a sewing machine of the type that is used with the subject invention.

FIG. 1 is a perspective view of a feed-off-the arm sewing machine 30 of the type that is can be used to join two plies of over lapped material with a lap seam. The machine shown in FIG. 1 is Union Special Corporation 36200 class flat seamer sewing machine and can produce a standard 607 stitch. The sewing machine 30 includes a head 32 from which a needle bar 34 and a presser foot bar 36 depend. The needle bar 34 is reciprocates vertically and caries a set of four needles 43 at its lower end. The pressor foot 1 is secured to the bottom free end of the pressor foot bar 36. Material to be sewn is supported by the sewing arm 44 which has a sewing area 22. A throat plate 45 is set into the sewing area 22 of sewing arm 44.

Figure 2:
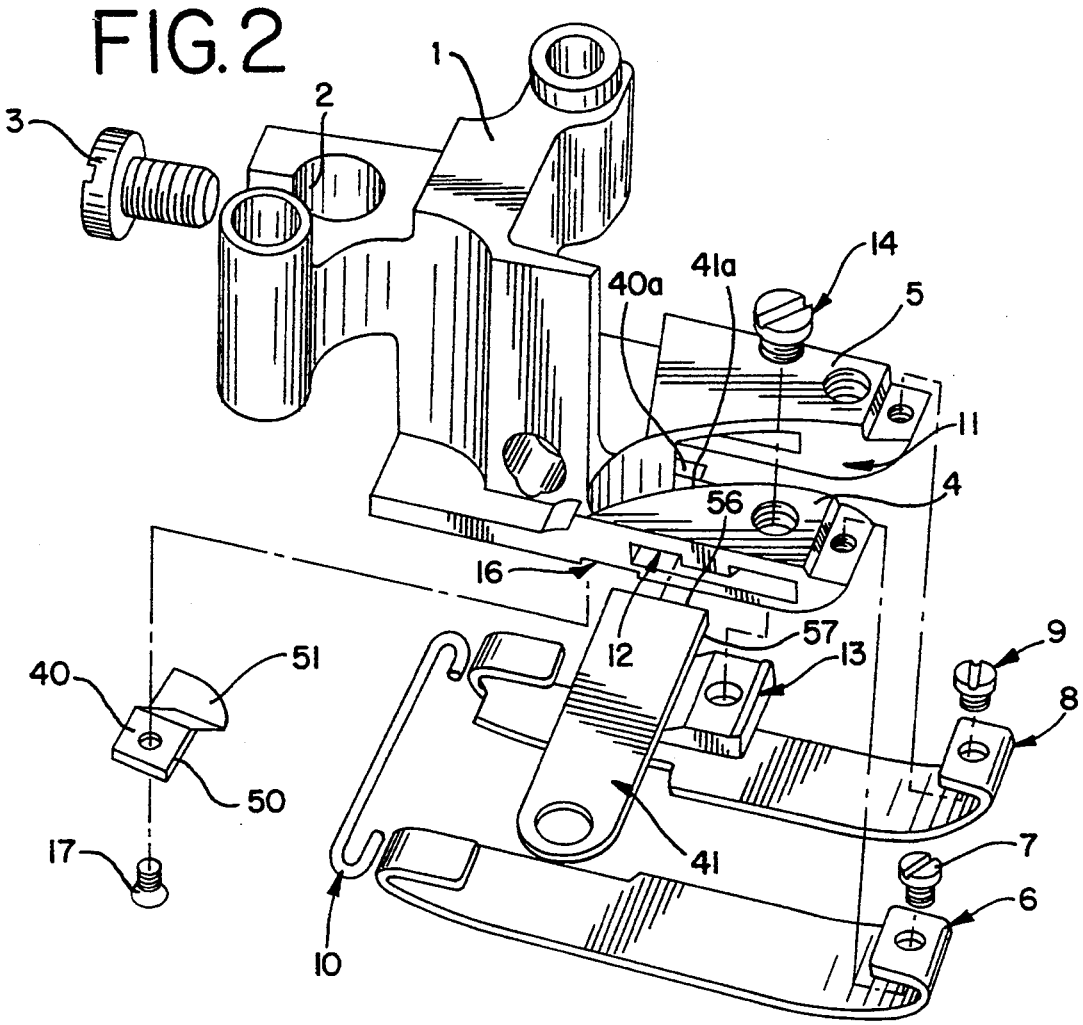
FIG. 2 depicts a top perspective of a presser foot end cloth guide containing one embodiment of the invention.

FIG. 2 illustrates a presser foot 1 that includes an aperture 2 through which the presser foot bar 36 extends and is secured by a screw 3. The reference terms "left" and "right" when used in this discussion are determined by looking along the direction that the material advances toward the needles. The pressed foot 1 has at the bottom a front left prong 4 and a front right prong 5, defining an open end portion 11. The left prong 4 has a left foot shoe 6, attached by a screw 7, and the right prong 5 has a right foot shoe 8, attached by a screw 9.

The left and right foot shoes 6, 8 are fastened together at the rear by a shoe holding wire 10.

A stationary cutting knife 41, having a cutting edge 56 and a front edge 57, fits into a knife slot 12 formed in left prong 4, and is secured by a stationary knife clamp 13 and a screw 14. A cloth guide 40 (shown removed from its assembled position) fits into a cloth guide slot 16, formed in the bottom surface of the left prong 4 of pressor foot 1, and is fastened thereto by a screw 17. The cloth guide 40 has a support portion 50 and a finger portion 51. When attached to the presser foot 1, the finger portion 51 is below the cutting knife 41. When performing a sewing operations where the left ply is on the bottom and the right ply is on the top, the finger portion 51 extends from the front left prong 4 toward the open end portion 11.

Figure 3:
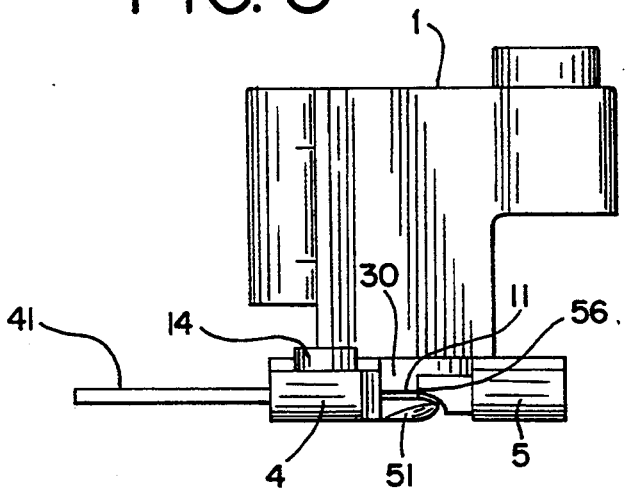
FIG. 3 depicts a front perspective of a presser foot and cloth guide containing one embodiment of the invention.

Referring now to FIG. 3 which shows the finger portion 51 extending further to the right than the cutting edge 56 of the stationary knife 41. The cloth guide 40 and stationary cutting knife 41 are shown assembled in FIG. 2 where they are identified as reference numerals 40*a* and 41*a*, respectively. The cloth guide 40 and stationary cutting knife 41 are also seen in their assembled position in FIG. 3.

It is preferred that the cloth guide and the knife be supported by the presser foot as illustrated in FIGS. 2 and 3, however, the cutting knife and the cloth guide may be supported in any manner which carries out the invention.

Figure 4A:
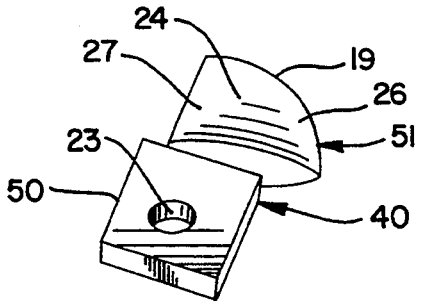
FIGS. 4*a* and 4*b* depicts two perspective views of a cloth guide embodiment of the invention.

As shown in FIG. 4*a*, the support portion 50 of the cloth guide 40 is generally flat and rectangular and has an aperture 23 for the fastening screw 17 (shown in FIG. 2).

Figure 4B:
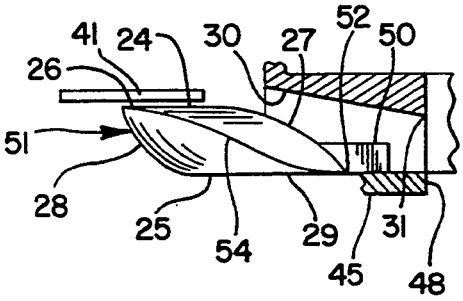

FIG. 4*b* illustrates a side perspective of the cloth guide 40 as viewed from the front right prong 5 when assembled. The finger portion 51 has a top 24 and a bottom 25. The front portion 26 of the top 24 is substantially flat and the back surface 27 of the top 24 slopes downward. The shape of the bottom 25 approximates the bottom shape of a spoon. The front portion 28 of the bottom 25 slopes downward and the back portion 29 of the bottom 25 is substantially flat. In FIG. 4*b* portion of the pressor foot 1 has been shown for the purpose of illustrating the cooperative relationship between back surface 27 of the cloth guide 40 and surface 30 of the pressor foot 1.

The bottom 25 guides a first ply of cloth downward below the finger portion 51, while the top 24 guides a second ply of cloth upward over the finger portion 51, separating the first ply from the second ply. When the second ply contacts the inside back portion 30 of the presser foot 1 (see FIGS. 3 and 4*b*) it is then guided downwardly. The inside back portion 30 of the pressor foot is a downwardly inclined surface having a rear lower edge 31 that is in substantial alignment with the front edge 48 of the needle opening 42 that is formed in the throat plate 45. The second or top ply is guided down between the inside back portion 30 of pressor foot 1 and the back surface 27 of the cloth guide 40. As a result positive control and guidance of the top ply is maintained until it reaches the lower edge 31 of the back portion 30, which overlies the front edge 48 of the needle opening 042. It should be noted, as best seen in FIG. 4*b*, lower edge 31 is considerably beyond the rear edge 52 of the cloth guide 40 and thus positive control and guidance of the fabric edge is maintained beyond the rear edge 52 of cloth guide 40. It should also be noted that when the fabric reaches lower edge 31 of back portion 30 the top ply is being pressed down into contact with the bottom ply and thus positive control and guidance is being exerted over both top and bottom plies up until the point where the fabric passes over the front edge 48 of the needle opening 42. In this embodiment, the first ply of cloth is the left ply and the second ply is the right ply.

Figure 5:
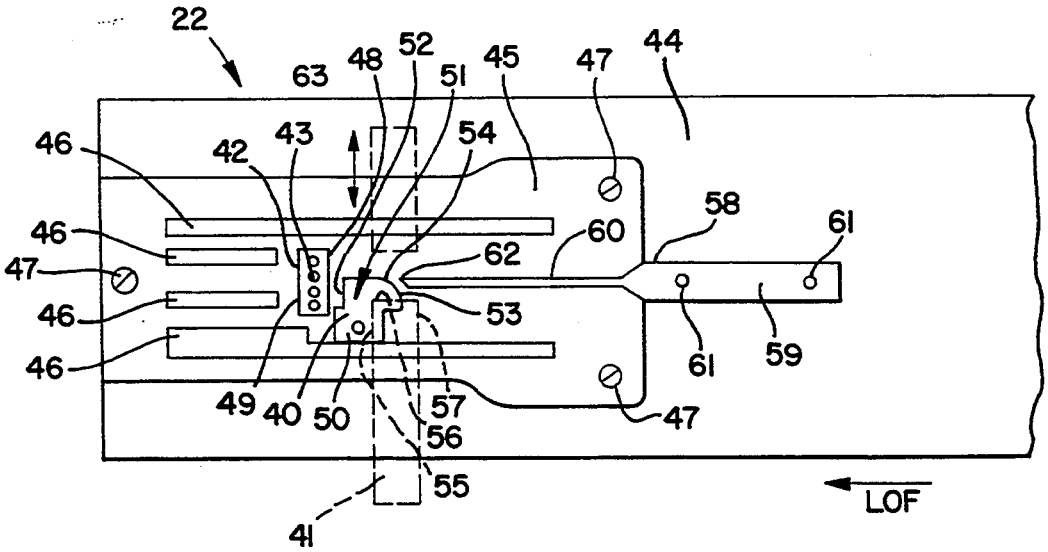
FIG. 5 depicts a top perspective of the sewing area of the arm of the machine including the throat plate, the cloth guide and the stationary knife.

FIG. 5 is a top perspective of a sewing area 22 of the sewing arm 44 the assembly illustrating the position of a cloth guide 40, a stationary cutting knife 41, movable cutting knife 63 and a needle opening 42 for receiving a plurality of needles 43 arranged in a plane. The sewing area 22 at the free end of sewing arm 44 has a throat plate 45 mounted therein which has conventional feed dog openings 46 and a needle opening 42 formed therein. The throat plate 45 is set into the sewing arm 44 and is fastened by screws 47. The needle opening 42 has a front edge 48 and a back edge 49.

The cloth guide 40 has a support portion 50 and a finger portion 51 which has a rear edge 52 and a front edge 53 that is formed along a curve 54 that is located at the distal side from said support portion 50. The stationary cutting knife 41 has a rear edge 55, a cutting edge 56 and a front edge 57. A lap finger 58 having a base 59 and a finger 60 is set into the sewing arm 44 and is attached by screws 61. The finger 60 is contoured and terminates in a point 62 which is shown disposed near the curve 54 of the finger portion 51 of the cloth guide 40.

The finger portion 51 of cloth guide 40 extends substantially between the needles 43 and the front edge 57 of the stationary cutting knife 41. Preferably, to avoid interference with the sewing operation, the rear edge 52 of the guiding portion 51 does not overlay the needle opening 42.

Figure 6A:
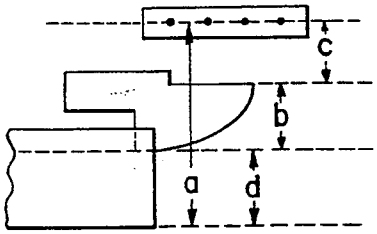
FIG. 6a PRIOR ART
FIG. 6*a* is a plan view showing the relationship between the cloth guide, the stationary knife and the needles in a prior art device.
Figure 7A:
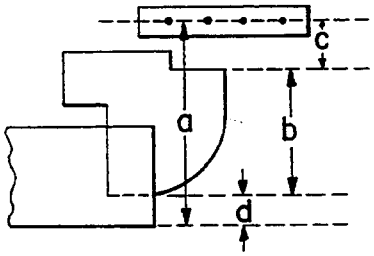
FIG. 7*a* is a plan view, similar to FIG. 6, showing the relationship between the cloth guide, the stationary knife and the needles in the subject invention.
Figure 6B:
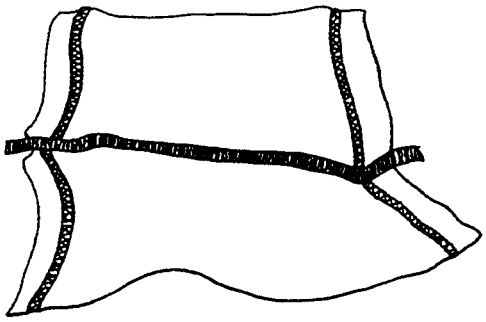
FIG. 6*b* is a plan view of material sewn on the prior art machine.
Figure 7B:
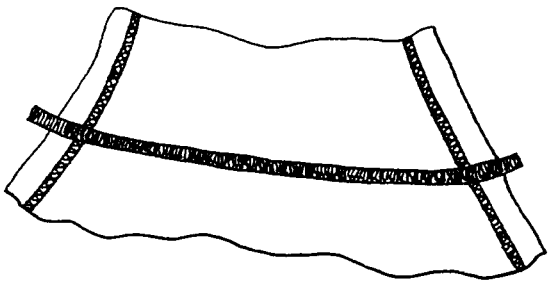
FIG. 7*b* is a plan view of material sewn on the machine of this invention.

Table 1 provides measurements for the arrangement depicted in FIG. 5, 6*a* and 7*a* and compares the invention, designated as Lap Device 1, to a prior art cloth guide, designated as Lap Device 2, used with a 36200 class flat seamer sewing machine, available from Union Special Corporation (part no. 36230 R, Ref. 21 on page 10 of Union Special Catalog No. T118H, Class 36200 High Speed Cylinder Flatseamer Machines, April, 1980).

TABLE 1

| Lap Device | (a) Front of knife to needle C/L | (b) Length of cloth guide* | (c) C/L of needle to rear cloth guide edge | (d) Front of knife to front cloth guide edge | (e) % (b)/(a) × 100 |
|---|---|---|---|---|---|
| 1 | .590 | .377 | .123 | .090 | 63.8% |
| 2 | .590 | .192 | .178 | .220 | 32.5% |

*measured at widest functional part

The sewing machine operator manually controls and guides the fabric against the lap finger 58 and maintains this control up to the front edge 57 of the cutting knife 41. Table 1 illustrates that in the prior art device the distance "d" was equal to 0.220 inches which is about 37% of the total distance between the front edge 57 of the stationary cutting knife 41 and the center line (C/L) of the needles. In this invention the distance "d" is equal to 0.090 inches which is about 15.3% of the total distance between the front edge 57 of the stationary cutting knife 41 and the center line (CL) of the needles. Thus in this invention positive control of the fabric is passed from the sewing machine operator to the cloth guide much sooner then in the prior art device.

Table 1 illustrates that the length of the cloth guide of the invention is almost twice as long as the cloth guide used previously, and will therefore be in contact with the plies for at lease twice the time if other variables such as the sewing speed and the number of stitches per inch remain the same.

To provide maximum control of the plies, the length of the cloth guide measured at its widest functional part (distance (b)) extends over a substantial portion (about 63.8%) of the distance between the front of the cutting knife and the sewing needle centerline (distance (a)). The distance that the cloth guide extends is limited by interference of the cloth guide with the cutting operation by the knife and laying down of the plies at the front, and the sewing operation of the needles at the rear. There must also be sufficient distance between the rear of the cloth guide and the needles to allow the two plies to be brought together before sewing the stitch. These distances will generally vary upon the thickness and type of cloth that is being sewn. In the embodiment illustrated in Table 1, the cloth guide of the invention covers about 63.8% of the total length between the front of the knife to the center line (C/L) of the needles to accommodate a thick binding material. In comparison, the prior art cloth guide covers only 32.5% of the total length.

In the invention, two plies are trimmed and laid down upon one another in a lap area before presentation to the sewing needles. In the embodiment illustrated in FIG. 5, a lap area is defined by the needles 43 at the rear and the front edge 57 of the stationary cutting knife 41 at the front. The lap area has a left and a right side generally defined by the space needed to perform the sewing operation. The finger portion 51 of the cloth guide 40, substantially traverses the distance between the rear and the front of the lap area.

In this embodiment, the right ply is laid down over the left ply. A left ply of cloth and a right ply of cloth are positioned near the base 59 of the lap finger 58. The butting edges of the plies are folded upward by the finger portion 60 in preparation for trimming by the stationary cutting knife 41 and a moveable cutting knife 63. Movable cutting knife 63 reciprocates toward and away from the stationary cutting knife 41 at a perpendicular angle to the line of feed (LOF) of the plies. After the plies are trimmed the left ply is guided below the bottom of the finger portion 51 of the cloth guide 40 and the right ply is guided over the top of the finger portion 51 of the cloth guide 40. The finger 60 is sufficiently sized to allow the plies to pass, and assists in guiding the right ply by preventing it from being carried downward with the left ply. The guiding portion 51 keeps the left and right plies separated until just before reaching the front edge 48 of the needle opening 42. As the right ply encounters the inside back portion 30 of presser foot 1 (see FIGS. 3 and **4*b*), the right ply is guided downward by the top back surface 27 of the finger portion 51 see FIG. 4*b*) and is laid on top of the left ply for presentation to the needles 43** for sewing.

In this manner, the invention produces a flat lapped seam and eliminates leaking of the stitch when sewing on and off the garment. Without being limited to theory, it is believed that the peaking problem is solved by controlling the left and right plies as soon as possible after trimming and as long as possible before presenting them to the needles for sewing. This is accomplished by extending the finger portion of the cloth guide substantially between the sewing needles and the front edge of the cutting portion of the stationary trim knife. The plies are controlled by the cloth guide immediately after cutting and are laid down upon one another with assistance from the cloth guide immediately before sewing. This control prevents the plies from being pulled apart or bunched up.

The invention is especially suited for sewing plies having a thick binding at one end. Thus, when sewing men's briefs, the invention eliminates peaking on the leg binding, which is thicker than the cloth ply, when sewing on or off the garment. The invention produces a flat lapped seam on the crotch and both sides of the stitch are trimmed and folded.

The invention is preferably used with a 36200 class flat seamer sewing machine, available from Union Special Corporation. The 36200 class machine can produce a 607 stitch, which is formed with four needle threads, one lopper thread and one cover thread, and an Lsa-1 type seam.

Figure 8:
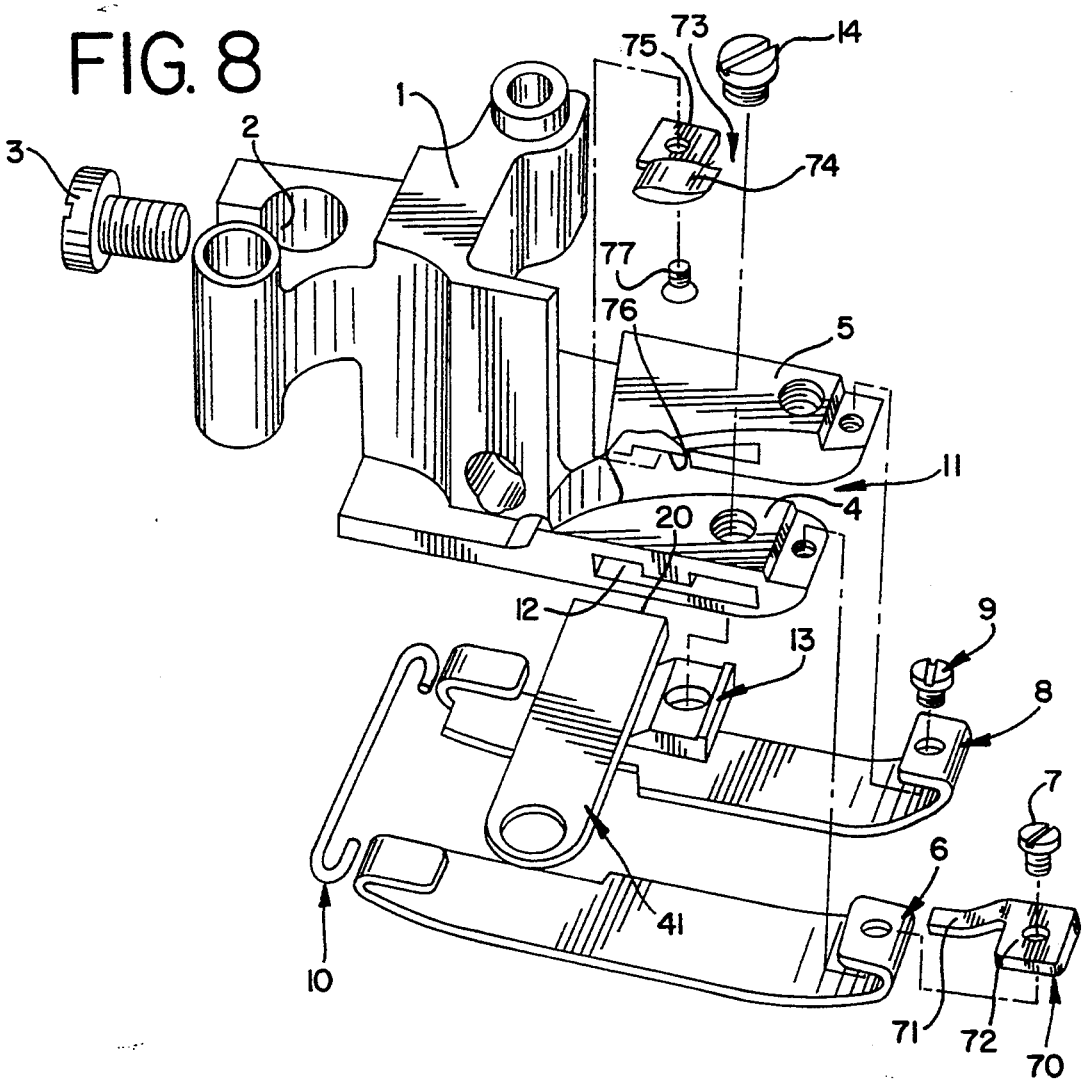
FIG. 8 depicts a top perspective of another embodiment of the invention showing a presser foot having two cloth guides.
Figure 9:
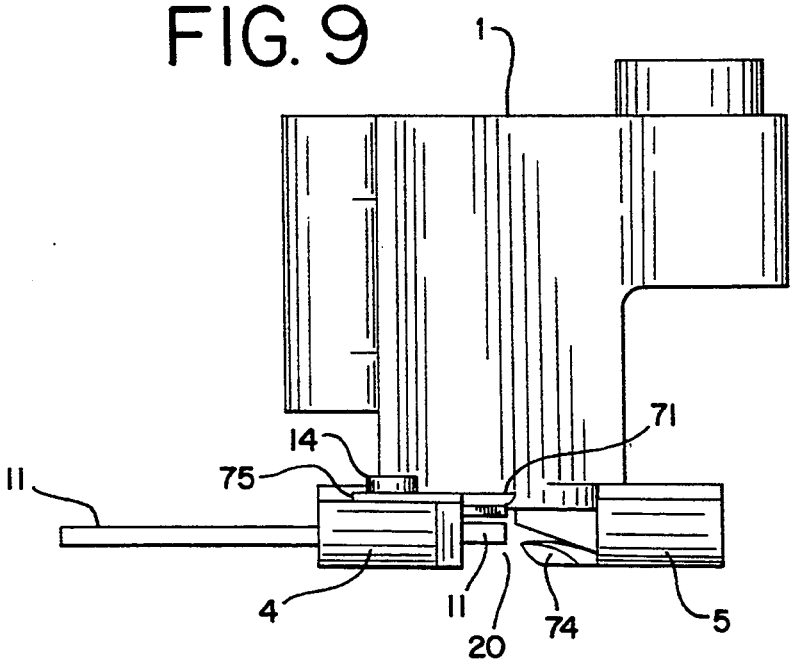
FIG. 9 depicts a front perspective of the of the embodiment shown in FIG. 8, showing a presser foot having two cloth guides.

The invention is normally used to lie the right ply down over the left ply. However, as shown in the embodiment illustrated in FIGS. 8 and 9, a lap seam may be sewn where the left ply is laid down over the right ply. FIG. 8 illustrates a first cloth guide 73 (which is similar in function to cloth guide 40 in FIG. 2) that contains a finger portion 74 and a support portion 75. The first cloth guide 73 is affixed to the bottom of the front right prong 5 in slot 76 by screw 77. The first cloth guide 73 functions to control the laying down operation as long as possible as previously described for cloth guide 40 in the discussion of FIGS. 1 to 7.

A second cloth guide 70 having a finger portion 71 and a support portion 72 is affixed to the top of the front left prong 4 of the presser foot by screw 7 and is forward of the stationary cutting knife 41. The second cloth guide 70 guides the left ply on top of the right ply for presentation to the sewing needles.

In an embodiment where the first cloth guide 73 is not necessary to the lap seaming operation, the cloth guide 70 may be used alone to assure that the left ply is laid down upon the right ply for the lap seaming operation.

The foregoing describes preferred embodiments of the invention and is not to be construed as a limitation of the invention which is set forth in the claims.

I claim:

1. A device for performing a lap seam stitch comprising:

a plurality of vertically reciprocating needles arranged in a needle plane;

a presser foot having a front left prong and a front right prong defining an open end portion therebetween;

a stationary cutting knife supported by said left prong of said presser foot, said stationary knife disposed forward of said needle plane and within said open end portion, said stationary knife including a rear edge and a front edge that is further from the needle plane than the rear edge and extends transverse to the line of material feed;

a cloth guide supported by a left prong of said presser foot, said cloth guide having a finger portion disposed within said open end portion and said finger portion spanning more than half of the distance between said needle plane and said front edge of said stationary cutting knife; and a lap finger disposed forward of said needle plane, said lap finger having a point disposed within said open end portion adjacent to said cloth guide.

2. The device of claim 1 wherein said finger portion of said cloth guide has a contoured top portion, a contoured bottom portion and a curved front edge.

3. The device of claim 1 wherein said cloth guide comprises a support portion, said finger portion of said cloth guide having a top and a bottom, and a curved edge at the distal side from said support portion, said top having a substantially flat front portion and a downward sloping back portion, and said bottom having a downward sloping front portion and a substantially flat back portion.

4. A sewing machine including a mechanism for performing a lap seam stitch comprising:

a plurality of vertically reciprocating needles mounted on said sewing machine and arranged in a needle plane;

a presser foot mounted on said sewing machine;

a cutting knife mounted on said presser foot and having a rear edge and a front edge that is further from the needle plane than the rear edge and disposed forward of said needle plane, said needle plane and said cutting knife front edge defining a lap area having a front defined by said cutting knife front edge, a rear defined by said needle plane, and a left and right side;

a cloth guide mounted on said presser foot having a finger portion disposed within said lap area forward of said needle plane and rearward of said front edge of said cutting knife, said finger portion spanning in excess of 50% of the distance between the rear and the front of said lap area; and a lap finger mounted on said sewing machine such that it is disposed forward of said needle plane, said lap finger having a point portion disposed within the front portion of said lap area.

5. The device of claim 4 wherein said cloth guide extends into the left side of the lap area.

6. The device of claim 4 wherein the cloth guide extends into the right side of the lap area.

7. The device of claim 6 further comprising a second cloth guide mounted on said presser foot and disposed forward of and above said cutting knife, and extending into the front left portion of said lap area.

8. The device of claim 4 wherein said cutting knife includes a cutting edge that is disposed within said lap area and arranged substantially perpendicular to said needle plane.

9. The device of claim 4 wherein said lap finger is disposed substantially perpendicular to said needle plane, and said point is disposed rearward of a front edge of said cutting knife.

10. A sewing machine including a mechanism for performing a lap seam stitch to join two cloth plies comprising:

reciprocal needle means mounted on said sewing machine;

a presser foot mounted on said sewing machine;

a cutting mechanism, including a rear edge and a front edge, mounted on said presser foot for trimming the edges of the cloth plies that are to be joined by the lap seam, said front edge being further from the reciprocal needle means than said rear edge, said cutting mechanism located forward of the reciprocal needle means; and a cloth guide having a front edge, said cloth guide mounted on said presser foot for forming a lap in said two cloth plies prior to being joined by the lap seam, said cloth guide including a finger portion substantially spanning the distance between said needle means and the front edge of said cutting mechanism, the front edge of said cloth guide being located rearwardly of the front edge of said cutting mechanism a distance equal to about 20% of the distance between said needle means and the front edge of said cutting mechanism.

* * * * *